United States Patent [19]

Ivanov

[11] 4,231,679

[45] Nov. 4, 1980

[54] DRY DOCK FOR BUILDING VESSELS

[76] Inventor: Jury P. Ivanov, Grazhdansky proezd, 92/2, kv. 1, Leningrad, U.S.S.R.

[21] Appl. No.: 968,856

[22] Filed: Dec. 12, 1978

[51] Int. Cl.[2] ..... B63C 1/08

[52] U.S. Cl. ..... 405/4; 405/6

[58] Field of Search ..... 405/4, 5, 6, 7; 114/45, 114/46, 47, 65 R

[56] References Cited

U.S. PATENT DOCUMENTS

| | | | |
|---|---|---|---|
| 3,489,118 | 1/1970 | Sugizaki et al. | 114/65 R |
| 4,018,180 | 4/1977 | Yoshida | 405/6 X |

FOREIGN PATENT DOCUMENTS

| | | | |
|---|---|---|---|
| 1802034 | 9/1970 | Fed. Rep. of Germany . | |
| 57342 | 2/1863 | France | 405/4 |
| 29289 | 2/1909 | Sweden | 405/4 |

*Primary Examiner*—David H. Corbin

*Attorney, Agent, or Firm*—Fleit & Jacobson

[57] ABSTRACT

A dry dock according to the invention is characterized by that it has a main chamber for assembling a middlebody with a fore end, and at least one side chamber communicating therewith and designed for assembling an aft end of a vessel. The side chamber is separated from the main chamber by an intermediate gate. The main chamber is divided by a separating gate into two areas: a building area in which the middlebody of the vessel is assembled with the fore end, and a launching area in which the vessel is completed and from which it is launched.

3 Claims, 2 Drawing Figures

DRY DOCK FOR BUILDING VESSELS

The invention relates to the shipbuilding, and more specifically to dry dock for building vessels.

Known the art is a dry dock for building vessels (cf. FRG Pat. No. 1,802,034, Cl. 65a, 9/00, 1970) comprising a main chamber and an adjoining side chamber arranged at right angle thereto. The side chamber is in permanent communication with the main chamber. A labour-consuming aft end with an engine room of the vessel is assembled in the side chamber; the main chamber is designed for assembling a middlebody, including cargo holds, as well as for mating individual parts of the hull into a complete structure.

After the vessel is completed, the dry dock, that is the main and side chambers are filled with water, and the vessel is led out into a water area.

Regular flooding of the side chamber of the dock containing aft ends of vessels following those being launched results in irregular timing of the assembly process, time losses for cleaning of the side chamber and vessel structures to remove mud, and in the end, in production time losses.

It is an object of the invention to reduce the dock period during building a vessel.

Another object of the invention is to eliminate the need in regular flooding of the side chamber during the launching of every next completed vessel from the dock, and production time losses associated therewith.

These and other objects are accomplished by that in a dry dock for building vessels, comprising a main chamber for assembling a middlebody with a fore end and at least one side chamber communicating therewith and designed for assembly of an aft end, according to the invention, the side chamber is separated from the main chamber by an intermediate gate, and the main chamber proper is divided by a separating gate into two areas: a building area in which the middlebody is assembled with the fore end, and a completion and launching area in which the vessel is completed and from which it is launched, the separating gate being arranged in the main chamber in such a manner as to form an extension of a wall of the side chamber, which is the nearest one to the end of the main chamber sealed during the launching of the vessel into a water area.

This enables the assembly of the middlebody with the fore end in the building area of the main chamber and aft ends in the side chamber without their flooding during the launching of a previously built vessel from the completion and launching area of the main chamber.

In case the main chamber having two outlets (of the Canalock type) is used, complete assembly of two vessels may be independently performed in both areas with the launching of each vessel from the dry dock without flooding the remaining areas of the dock.

The invention will now be described with reference to a specific embodiment thereof illustrated in the accompanying drawings, in which.

Figure 1:
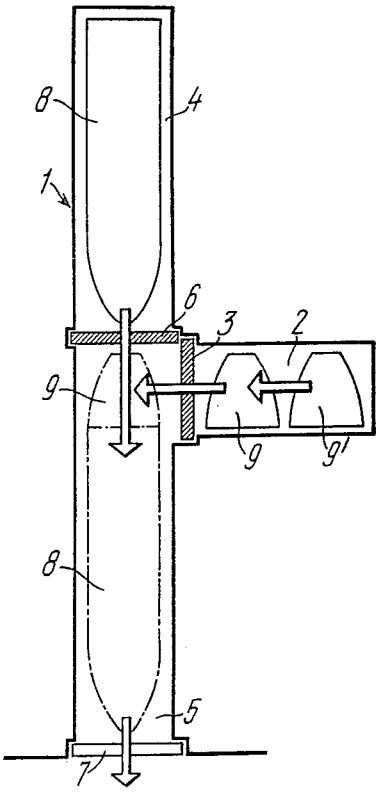
FIG. 1 is a diagrammatic plan view of a dry dock having a main chamber with a single outlet to a water area, according to the invention.

A dry dock according to the invention comprises a main chamber 1 (FIG. 1) having one outlet to a water area, and at least one side chamber 2 connected to the main chamber 1 and arranged at right angle thereto. The number of the side chambers may be greater, e.g. two side chambers may be provided and arranged relative to the main chamber 1 in accordance with the adopted procedure of vessel formation.

The side chamber 2 is separated from the main chamber 1 by an intermediate gate 3.

The main chamber 1 is divided into two areas: a building area 4 and a completion and launching area 5, by means of a separating gate 6, and is separated from the water area by a lock gate 7.

The building area 4 of the main chamber 1 is used for assembling a middlebody 8 with a fore end. The completion and launching area 5 of the main chamber 1 is used for joining the middlebody 8 with an aft end 9, completing the vessel and its launching.

In the description given below the parts relating to one and the same vessel are indicated by reference numerals having the same superscript.

The aft end 9 is assembled in the side chamber 2.

The separating gate 6 is arranged in the main chamber 1 in such a manner as to form an extension of a wall of the side chamber 2, which is the nearest one to the end of the main chamber 1 sealed during the launching of the vessel into the water area.

Vessels are assembled in the dry dock of the present invention (FIG. 1) in the following manner.

The middlebody 8 is assembled with the fore end in the building area 4 of the main chamber 1, and the aft end 9 is assembled in the side chamber 2. After a previously built vessel has been led out of the completion and launching area 5 of the main chamber 1 and the completion and launching area 5 has been dried, the middlebody 8 with the fore end is transferred thereto from the building area 4. The aft end 9 is also transferred to the area 5. An aft end 9' is transferred to the vacant position. A next vessel is laid down in the vacant building area 4, whereas in the side chamber 2 a new aft end is laid down. After the middlebody 8 is joined with the aft end 9, and the vessel is completed, the gates 3 and 6 are closed, the completion and launching area 5 of the main chamber 1 is filled with water, and, after the gate 7 is opened, the vessel is led out of the dock into the water area.

Figure 2:
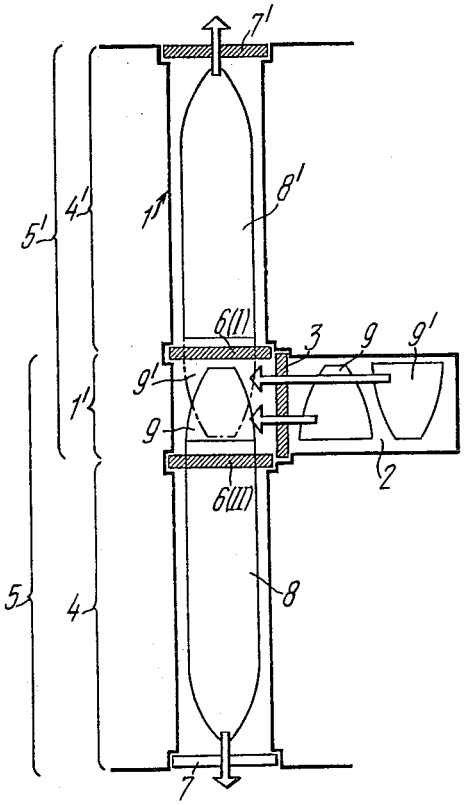
FIG. 2 is a diagrammatic plan view of a dry dock having a main chamber with two outlets to a water area, according to the invention.

Alternatively, the main chamber 1 may have two outlets to the water area located at the opposite ends (FIG. 2) (of the Canalock type). In such an embodiment the separating gate 6 is installed alternately into positions I or II so as to form an extension of one or another wall of the side chamber 2.

An area 1' of the main chamber 1 between the two positions of the gate 6 is used for installation of the aft ends 9 and 9' of the vessels assembled in the side chamber 2 and for joining them to the respective middlebodies 8 and 8' assembled with the fore ends.

Areas 4 and 4' of the main chamber 1 defined by the gate 6 set in the positions I and II of and the lock gates 7 and 7' are used for assembling the middlebodies 8 and 8' with the fore ends.

The sequence of the formation and launching of vessels is the following.

When the separating gate 6 is set in the position I, the area 4' is used for assembling the middlebody 8' of the second vessel with the fore end, i.e. as the building area for assembling the second vessel. At the same time, the first vessel is completed in the area 4+1', i.e. the area 4+1' is used as the completion and launching area 5 for completion and assembly of the first vessel. After the first vessel is led out of the dock to the water area, and the completion and launching area 5 is dried, the gate 6 is set in the position II, the aft end 9' of the second vessel is transferred to the middle area 1', attached to the middlebody 8' of the second vessel having the fore end, and, after the installation of the intermediate gate 3 and opening of the lock gate 7', the vessel is led out of the dock into the water area. The gate 7 remains closed during this period. Thus, the areas 4' and 1' are used as the completion and launching area 5' of the main chamber 1 for completion and launching of the second vessel, and the separating gate 6 which is in the position II forms an extension of a wall of the side chamber 2, which is the nearest one to the end of the main chamber 1 sealed by the lock gate 7 during the launching of the second vessel into the water area. A middlebody of a third vessel is assembled with the fore end in the previously vacated building area 4 of the main chamber 1.

In another embodiment (not shown) the main chamber 1 may be without the separating gate 6. In such case the sequence of assembly of a vessel is similar to that shown in FIG. 1, but the entire main chamber 1 is flooded during the launching of the vessel into the water area.

The above-described dry dock constructions also enable a ready launching of individual parts of a hull in any combinations from the dock: middlebody independently, aft or fore end together with the middlebody.

The main advantage of the invention resides in an intensification of the utilization of an investment-consuming dock by providing an independent operation of the building area and completion and launching area of its chamber, and by reducing the operation costs for vessel launching owing to the reduction of the volume of water pumped from the dock and elimination of cleaning operations to remove mud from the dock.

What is claimed is:

1. A dry dock for building vessels including an aft end, a middlebody and a fore end, comprising:

a main chamber having two ends at, least one of the ends being openable to a water area;

a separating gate positionable in said main chamber for dividing it into an assembly area and a completion and launching area, a middlebody of a vessel being assembled with a fore end in said assembly area, and the same vessel being completed in and launched from said completion and launching area;

at least one side chamber extending perpendicular to said main chamber for assembling an aft end of the vessel, the aft end being joined with the middlebody in said completion and launching area;

an intermediate gate installed between said side and main chambers for separating them from one another so that said side chamber is not flooded during launching of a vessel;

said separating gate being arranged in said main chamber in such a manner as to form an extension of a wall of said side chamber, which is the nearest wall to said assembly area of said main chamber, so that a first vessel can be launched from said completion and launching area without flooding said assembly area whereby a middlebody and a fore end of a second vessel can be assembled in said assembly area while said completion and launching area is flooded.

2. A dry dock according to claim 1, wherein said main chamber has first and second ends that are both openable to a water area, and wherein said separating gate is movable between first and second separating positions, in said first separating position said separating gate forming an extension of a wall of said chamber, which is the nearest wall to said second end of said main chamber so that said assembly area is defined between said second end and said separating gate; and in said second separating position said separating gate forming an extension of a wall of said side chamber, which is the nearest wall to said first end of said main chamber so that said assembly area is defined between said first end and said separating gate.

3. A dry dock according to claim 2, wherein said separating gate is movable from one separating position to the other after launching of a vessel so that an assembly area becomes a completion and launching area.

* * * * *